US011104129B2

(12) United States Patent
Peng et al.

(10) Patent No.: US 11,104,129 B2
(45) Date of Patent: Aug. 31, 2021

(54) MEMS DEVICES AND METHODS OF FABRICATION THEREOF

(71) Applicant: Taiwan Semiconductor Manufacturing Company, Ltd., Hsinchu (TW)

(72) Inventors: Jung-Huei Peng, Jhubei (TW); Chun-Ren Cheng, Hsinchu (TW); Jiou-Kang Lee, Zhu-bei (TW); Shang-Ying Tsai, Pingzhen (TW); Ting-Hau Wu, Yilan (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 0 days.

(21) Appl. No.: 16/587,912

(22) Filed: Sep. 30, 2019

(65) Prior Publication Data

US 2020/0023642 A1 Jan. 23, 2020

Related U.S. Application Data

(62) Division of application No. 15/959,988, filed on Apr. 23, 2018, now Pat. No. 10,688,786, which is a division of application No. 14/859,835, filed on Sep. 21, 2015, now Pat. No. 9,950,522, which is a division of application No. 12/683,550, filed on Jan. 7, 2010, now Pat. No. 9,138,994.

(60) Provisional application No. 61/157,127, filed on Mar. 3, 2009.

(51) Int. Cl.

| | |
|---|---|
| ***B41J 2/14*** | (2006.01) |
| ***B41J 2/16*** | (2006.01) |

(52) U.S. Cl.

CPC ..... *B41J 2/14088* (2013.01); *B41J 2/14016* (2013.01); *B41J 2/16* (2013.01); *B41J 2/1626* (2013.01); *B41J 2/1639* (2013.01); *B41J 2/1642* (2013.01); *B41J 2/1646* (2013.01)

(58) Field of Classification Search

None

See application file for complete search history.

(56) References Cited

U.S. PATENT DOCUMENTS

| | | | | |
|---|---|---|---|---|
| 5,652,671 | A | 7/1997 | Knipe et al. | |
| 6,479,166 | B1 * | 11/2002 | Heuer | C23C 16/24 257/E21.101 |
| 7,183,618 | B2 | 2/2007 | Ishii | |
| 7,328,978 | B2 | 2/2008 | Silverbrook et al. | |
| 7,377,623 | B2 | 5/2008 | Silverbrook et al. | |
| 7,586,669 | B2 | 9/2009 | Pan | |
| 2002/0185699 | A1 * | 12/2002 | Reid | B81B 3/0078 257/414 |
| 2004/0076857 | A1 | 4/2004 | Sjolen et al. | |
| 2005/0046676 | A1 * | 3/2005 | Silverbrook | B41J 2/1412 347/56 |

(Continued)

*Primary Examiner* — Erica S Lin

(74) *Attorney, Agent, or Firm* — Slater Matsil, LLP

(57) ABSTRACT

MEMS devices and methods of fabrication thereof are described. In one embodiment, the MEMS device includes a bottom alloy layer disposed over a substrate. An inner material layer is disposed on the bottom alloy layer, and a top alloy layer is disposed on the inner material layer, the top and bottom alloy layers including an alloy of at least two metals, wherein the inner material layer includes the alloy and nitrogen. The top alloy layer, the inner material layer, and the bottom alloy layer form a MEMS feature.

20 Claims, 9 Drawing Sheets

(56) References Cited

U.S. PATENT DOCUMENTS

| | | | | |
|---|---|---|---|---|
| 2005/0179741 | A1 | 8/2005 | Silverbrook et al. | |
| 2006/0221135 | A1 | 10/2006 | Silverbrook et al. | |
| 2008/0030842 | A1 | 2/2008 | Mangrum et al. | |
| 2008/0259131 | A1 | 10/2008 | Cornell et al. | |
| 2008/0264565 | A1* | 10/2008 | Sun | C04B 35/505 156/345.1 |
| 2009/0110846 | A1 | 4/2009 | Wiszniewski et al. | |
| 2016/0009089 | A1 | 1/2016 | Peng et al. | |

* cited by examiner

MEMS DEVICES AND METHODS OF FABRICATION THEREOF

This application is a divisional of U.S. patent application Ser. No. 15/959,988, filed on Apr. 23, 2018, and entitled "MEMS Devices and Methods of Fabrication Thereof," which is a divisional of U.S. patent application Ser. No. 14/859,835, filed on Sep. 21, 2015, now U.S. Pat. No. 9,950,522 issued on Apr. 24, 2018, and entitled "MEMS Devices and Methods of Fabrication Thereof," which is a divisional of U.S. patent application Ser. No. 12/683,550, filed on Jan. 7, 2010, now U.S. Pat. No. 9,138,994 issued on Sep. 22, 2015, and entitled "MEMS Devices and Methods of Fabrication Thereof," which claims the benefit of U.S. Provisional Application No. 61/157,127, entitled "MEMS Devices and Methods of Fabrication Thereof," filed on Mar. 3, 2009, which applications are incorporated herein by reference.

TECHNICAL FIELD

The present invention relates generally to MEMS devices, and more particularly to MEMS devices and methods of fabrication thereof.

BACKGROUND

Micro electro mechanical system (MEMS) devices are a recent development in the field of integrated circuit technology and include devices fabricated using semiconductor technology to form mechanical and electrical features. Examples of MEMS devices include gears, levers, valves, and hinges. Common applications of MEMS devices include accelerometers, pressure sensors, actuators, mirrors, heaters, and printer nozzles.

MEMS devices are exposed to harsh environments during their operational lifetime. Depending on the device type, MEMS devices may be subjected to corrosive environments, cyclic mechanical stress at high frequencies, high temperatures, etc. Hence, the lifetime of a typical MEMS device is constrained by the reliability of the electro-mechanical feature. One of the challenges in forming MEMS devices requires forming devices with high reliability at low costs.

Hence, what is needed are designs and methods of forming MEMS devices that enhance product reliability and lifetime without increasing production costs.

SUMMARY OF THE INVENTION

These and other problems are generally solved or circumvented, and technical advantages are generally achieved, by preferred embodiments of the present invention.

Embodiments of the invention include MEMS devices and methods of fabrication thereof. In accordance with an embodiment of the present invention, a MEMS device comprises a bottom alloy layer disposed over a substrate. An inner material layer is disposed on the bottom alloy layer, and a top alloy layer is disposed on the inner material layer, the top and bottom alloy layers comprising an alloy of at least two metals, wherein the inner material layer comprise the alloy and nitrogen. The top alloy layer, the inner material layer, and the bottom alloy layer form a MEMS feature.

The foregoing has outlined rather broadly the features of an embodiment of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 1, which includes

FIG. 3, which includes

FIG. 4, which includes FIGS. 4*a* and 4*b*, illustrates an alternative embodiment of the print head, wherein FIG. 4*a* is a cross sectional view and FIG. 4*b* is a top view;

FIG. 5, which includes

FIG. 6, which includes

FIG. 8, which includes

FIG. 9, which includes FIG. 10, which includes FIGS. 10*a*-10*c*, illustrates x-ray diffraction patterns of material layers fabricated using embodiments of the invention, wherein FIG. 10*a* illustrates x-ray diffraction patterns of a first material comprising an alloy with an amorphous structure, FIG. 10*b* illustrates x-ray diffraction peaks of a nanostructure comprising crystalline and amorphous regions, and FIG. 10*c* illustrates x-ray diffraction peaks of a second material comprising a crystalline structure.

Corresponding numerals and symbols in the different figures generally refer to corresponding parts unless otherwise indicated. The figures are drawn to clearly illustrate the relevant aspects of the embodiments and are not necessarily drawn to scale.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely MEMS devices used for print heads and/or micro mirrors. The invention may also be applied, however, to other electrical or mechanical devices.

The use of MEMS devices in extreme operating conditions requires improvements in reliability of critical features such as moving parts exposed to repeated or high stress levels, features or surfaces exposed to various chemicals, and/or high electric fields. Most of these effects are non-linear in nature and result in rapid failure. For example, under corrosive environments, the stress to failure or the time to failure under low stress levels decreases precipitously. In various embodiments, the invention overcomes the limitations of the prior art by forming MEMS device features using a combination of materials that result in improved electrical, mechanical, and chemical properties.

Embodiments of the invention will be described for use as a hinge for a moving part using FIGS. 1 and 2. Embodiments of the invention forming print head heaters will be described using FIGS. 3 and 4. Structural embodiments of films used as MEMS device features will be described using FIGS. 5 and 6. A method of forming the MEMS devices will be described using FIG. 7. Methods of fabrication of a print head will be described using FIGS. 8 and 9.

Figure 1A:
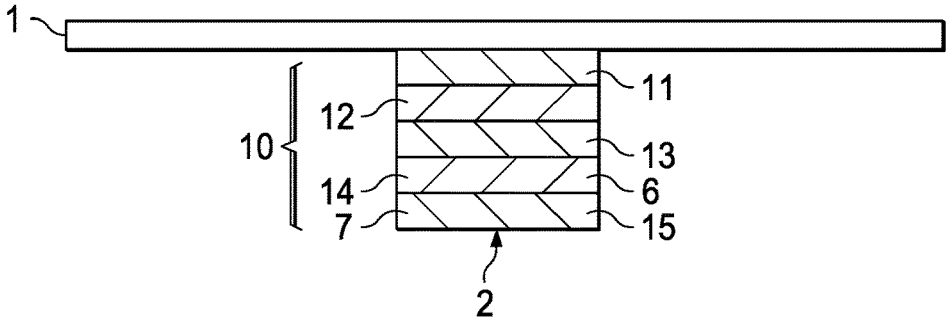
FIGS. 1*a* and 1*b*, illustrates an embodiment of the invention used as a hinge for a moving element.
Figure 1B:
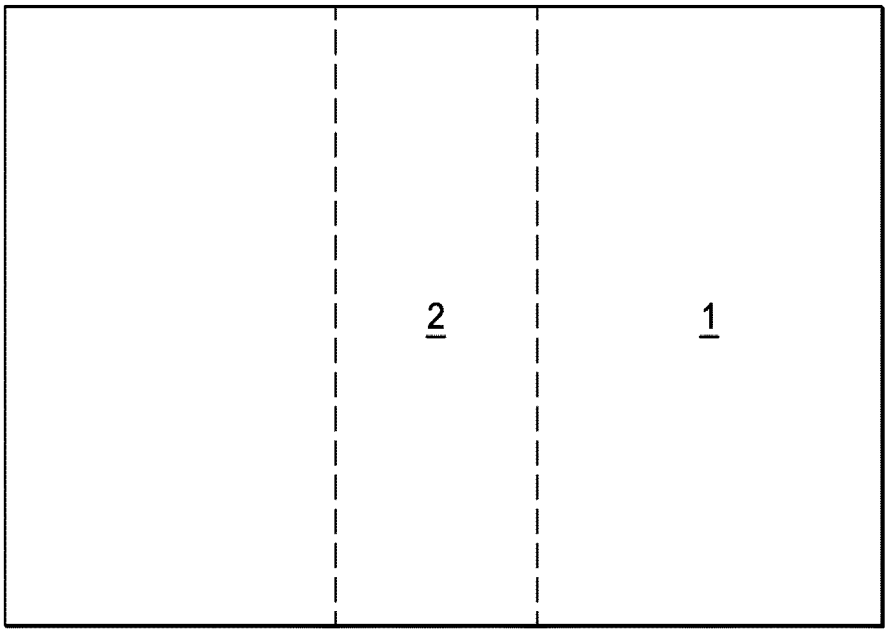
Figure 2:
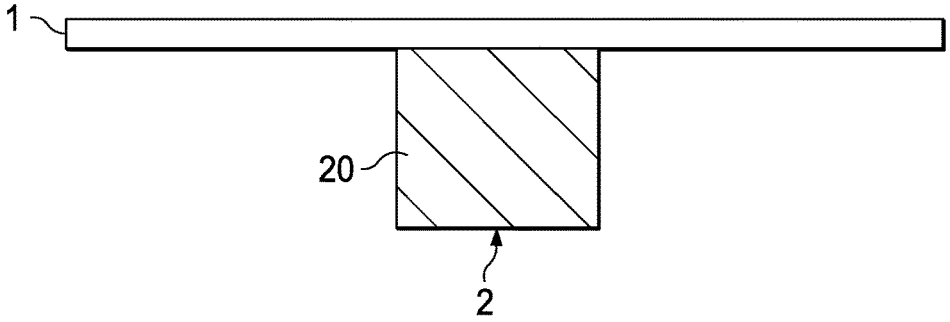
FIG. 2 illustrates an alternative embodiment of a hinge for a moving element, comprising a nanostructure including at least two material regions.

FIGS. 1 and 2 illustrate a hinge for a micro-mirror device, in accordance with embodiments of the invention.

A micro-mirror device comprises an array of hundreds or thousands of tiny tilting mirrors. Light incident on the micro-mirror is selectively reflected or not reflected from each mirror to form images on an image plane. The mirrors are spaced by means of air gaps over underlying control circuitry. The control circuitry provides electrostatic forces, which cause each mirror to selectively tilt. The mirrors are typically supported by hinges that enable the free tilting motion.

Due to repeated cycling of the mirrors during a product's operation, the hinge is subject to mechanical stress cycling and may eventually fail. For example, MEMS devices exposed to repeated stress levels even below the yield strength or maximum tensile strength fail due to creep. Prolonged use of the product, which typically heats up the devices further increases creep as well as corrosion which results in a lowering of the product's lifetime. Further, any micro-cracks developed either during fabrication or later may propagate through the hinge resulting in failure of the micro mirror device. In various embodiments, the invention avoids or extends the lifetime of the micro mirror hinge by using a film comprising a combination of materials that mitigate creep and/or corrosion while maximizing toughness.

FIG. 1, which includes FIGS. 1*a* and 1*b*, illustrates an embodiment of the invention in use as a hinge for a moving element.

FIG. 1*a* illustrates a MEMS device with a moving element 1 supported by a hinge 2. FIG. 1*b* illustrates a top view of the MEMS device with the moving element 1 supported by the hinge 2. The hinge 2 comprises a multi-layer film stack 10. In one embodiment, the multi-layer film stack 10 comprises a first material layer 11, a second material layer 12, a third material layer 13, a fourth material layer 14, and a fifth material layer 15. In one embodiment, the second material layer 12 and the fourth material layer 14 comprise a first material 6, whereas the first material layer 11, the third material layer 13, and the fifth material layer 15 comprise a second material 7. In one embodiment, the first material 6 comprises a TiAl alloy comprising about equal amounts of Ti and Al, and the second material 7 comprises TiAlN. The second material 7 comprises about equal amounts of Ti and Al in one embodiment.

In various embodiments, the first material 6 comprises a material with higher toughness than the second material 7, and the second material 7 comprises a material with high resistance to corrosion. The combination of the first material 6 with the second material 7 results in a film with high toughness and resistance to corrosion.

In another embodiment, the multi-layer film stack 10 comprises a first material layer 11, a second material layer 12, and a third material layer 13. In one embodiment the first material layer 11 and the third material layer 13 comprise the same material and form the portion of the multi-layer film stack 10 exposed to the environment. The multi-layer film stack 10 is further described using FIG. 5.

FIG. 2 illustrates an alternative embodiment of the hinge 2 comprising a nanostructure in accordance with an embodiment of the invention. As illustrated in FIG. 2, the hinge 2 comprises a single alloy composition but comprises a nanostructure 20. The nanostructure 20 of the hinge 2 comprises amorphous regions rich in a first material and columnar grains rich in a second material. In one embodiment, the first material comprises TiAl and the second material comprises TiAlN. The nanostructure 20 is further described using FIG. 6.

Figure 3A:
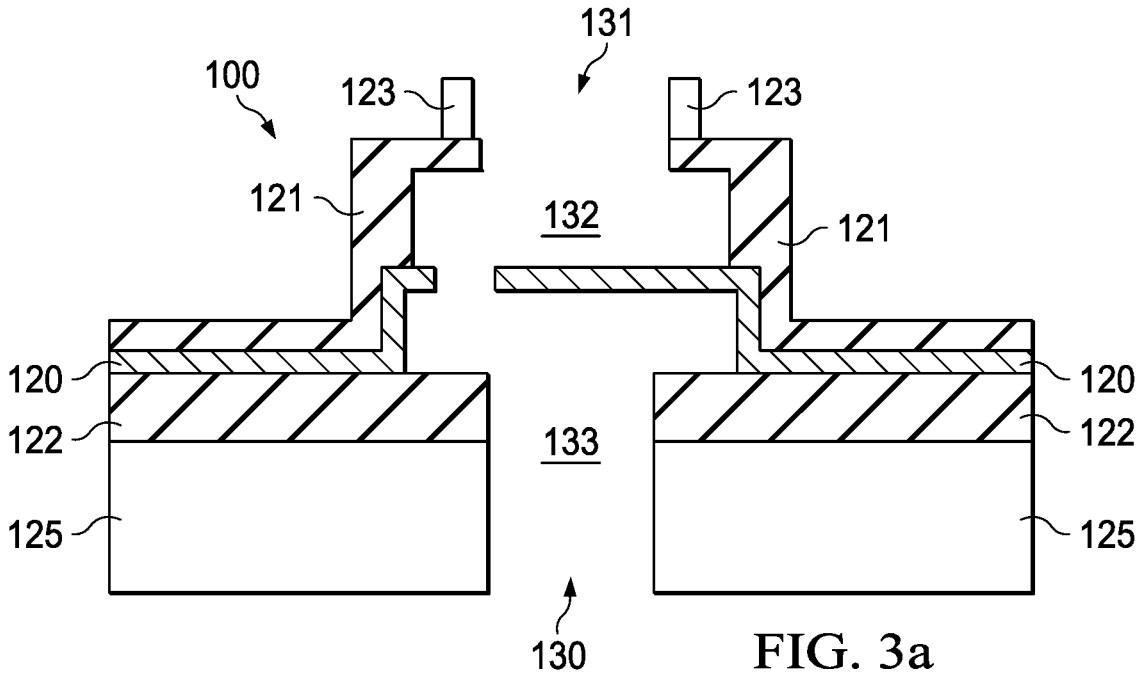
FIGS. 3*a* and 3*b*, illustrates a print head using a multi-layer film stack or a nanostructure comprising at least two material regions, in accordance with embodiments of the invention.
Figure 3B:
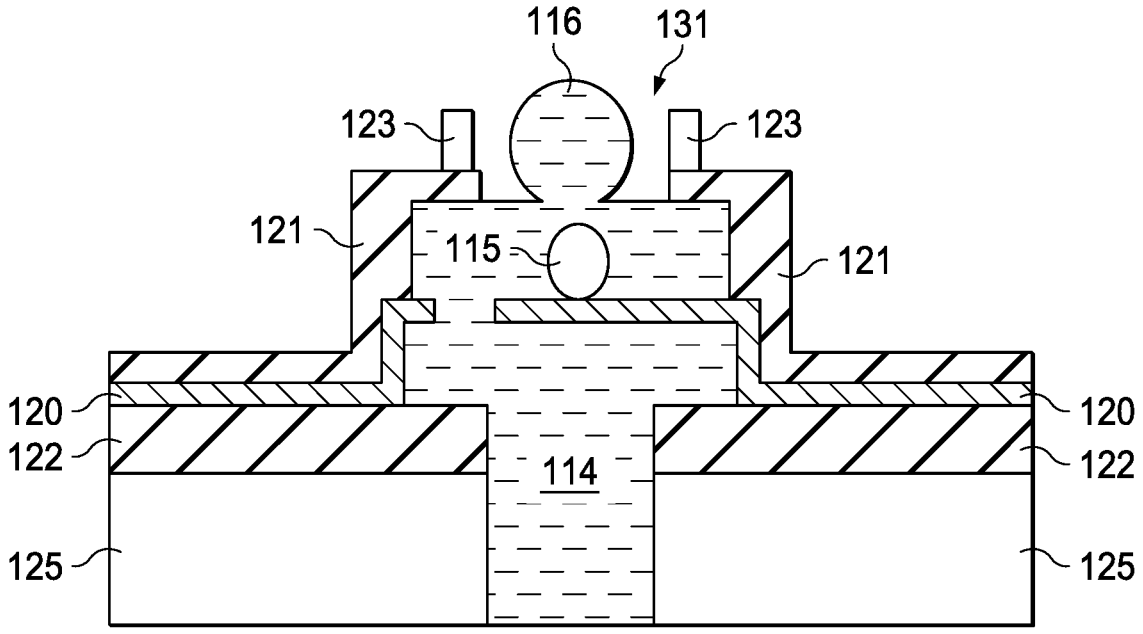

FIG. 3, which includes FIGS. 3*a* and 3*b*, illustrates a print head 100 using a multi-layer film stack 10 or nanostructure 20, in accordance with embodiments of the invention.

Referring to FIG. 3*a*, a print head 100 is disposed over a workpiece 125. The workpiece 125 may comprise integrated circuitry such as transistors, capacitors, diodes, and other devices. A passivation layer 122 is disposed over the workpiece 125.

A nozzle 121 is disposed over the workpiece 125. The nozzle 121 comprises a top opening 131 surrounded by opening sidewalls 123. The nozzle 121 comprises an insulating material and, in one embodiment, comprises silicon nitride.

The print head 100 comprises a top ink chamber 132 formed by the sidewalls of the nozzle 121, and a bottom ink chamber 133 disposed within the workpiece 125. The bottom ink chamber 133 is fluidly coupled to an ink tank (not shown) through the bottom opening 130.

A heater 120 is suspended between the top ink chamber 132 and the bottom ink chamber 133. In various embodiments, the heater 120 comprises a multi-layer film stack 10 (for example, as further described in FIG. 5). In one embodiment, the multi-layer film stack 10 comprises at least one layer of TiAlN and at least one layer of TiAl. In one embodiment, the heater 120 comprises a top and a bottom layer of TiAlN, and an inner layer of TiAl. In another embodiment, the heater 120 comprises a top and a bottom layer of TiAlN and two inners layers of TiAl. The two inner layers of TiAl are separated by a layer of TiAl.

FIG. 3*b* illustrates the print head during operation. The top and the bottom ink chambers 132 and 133 are filled with an appropriate ink 114 stored in the ink tank. A current is passed into the heater 120, for example, as a short duration pulse. The heater 120 heats up due to its resistivity. The heating of the heater 120 forms a bubble 115 within the top ink chamber 132. If enough heat is generated through the electrical pulse, a stable bubble nucleates, which pushes an ink droplet 116 out through the top opening 131 of the nozzle 121.

In various embodiments, the heater 120 comprises the multi-layer film stack 10 or a nanostructure 20. The multi-layer film stack 10 comprises a structure as described below using FIG. 5. The nanostructure 20 comprises a structure as described below using FIG. 6.

TiAl comprises a resistance that is lower than TiAlN. Further, TiAl forms a film with better uniformity in resistivity than TiAlN. However, TiAl has poor resistance to corrosion and easily corrodes when used as a heating element. This results in a reduced lifetime if only TiAl is used. In contrast, TiAlN has better corrosion resistance than TiAl. But, TiAlN is brittle and has lower strength than TiAl. TiAlN also exhibits poor uniformity in resistance and hence, is prone to hot spots. Hot spots on the electrode can result in discrepancies in droplet shape and, in extreme cases, failure of the heater itself. In various embodiments, the heater element comprises a multi-layer film stack 10 or a nanostructure comprising TiAl and TiAlN. The combination of the two materials results in improved mechanical, chemical, and electrical properties.

In various embodiments, the heater 120 may comprise any suitable shape to facilitate its use as a heater 120 for the print head 100. Similarly, the print head 100 may comprise additional elements and/or a different configuration.

Figure 4A:
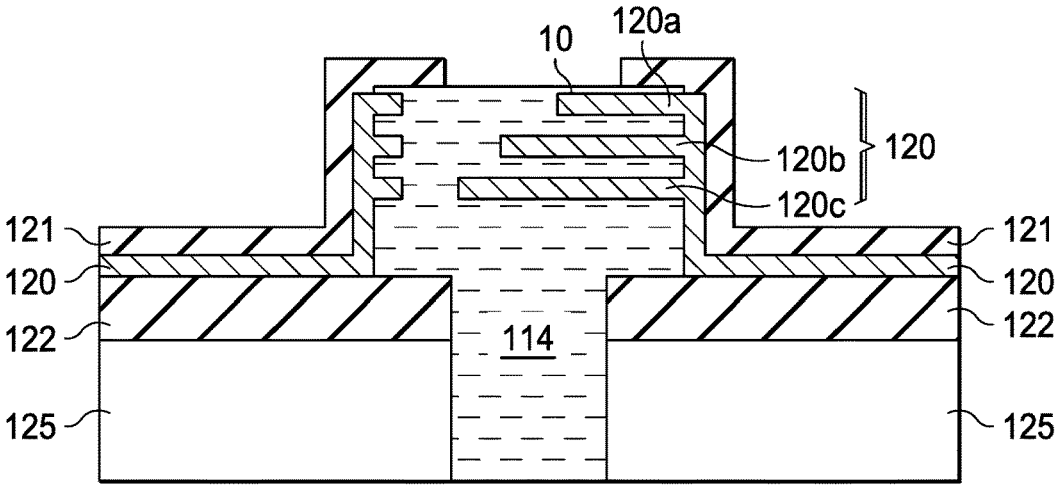
Figure 4B:
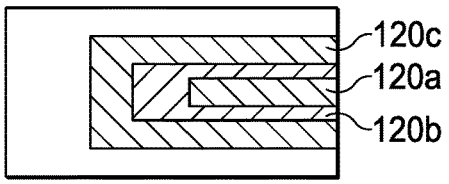

FIG. 4, which includes FIGS. 4*a* and 4*b*, illustrates an alternative embodiment of the print head 100.

Referring to FIG. 4*a* and unlike the embodiment illustrated in FIG. 3, the heater 120 comprises multiple levels or multiple features. The heater 120 comprises a first heating level 120*a*, a second heating level 120*b*, and a third heating level 120*c* each comprising a different surface area (FIG. 4*b*). A multiple level heater may be used, for example, to form droplets of different sizes which may be used to change the printing speed. Each of the first heating level 120*a*, the second heating level 120*b*, and the third heating level 120*c* generate heat and form a bubble over it. The respective bubbles coalesce to form a large bubble.

However, it is necessary to synchronize the time to form the bubbles using all the heating levels. Changing the surface area of the droplet also changes the total heat generated from the heater 120 and hence the time to form a bubble. Hence, multiple heater levels with different surface areas may be out of sync. To overcome this and synchronize the heater levels, each of the heater levels is typically coupled to a different active circuitry. For example, a lower level with a larger surface area may be connected to a first transistor circuitry driving a larger current than a different level with a smaller surface area which may be connected to a second transistor circuitry driving a smaller current (or larger current as necessary).

In various embodiments, the current embodiment avoids these problems as the resistivity of the heater levels is changed during the fabrication process. All the heating elements are coupled to the same active circuitry. However, each of the heater levels comprises a different resistivity. The difference in resistivity of the heater levels offsets the difference in heat generated due to the difference in the surface area.

In various embodiments, each heater level of the heater 120 comprises a multi-layer film stack 10. The multi-layer film stack 10 comprises layers of a first material 6 and a second material 7. The first material 6 comprises a lower resistivity than the second material 7. Each of the heater levels uses a different arrangement and/or thickness of the first material 6 and the second material 7 in the multi-layer film stack 10, thus forming films of different resistivity. As the difference in heating current can be pre-calculated, the thickness of each of the individual layers can be established correctly during development of the heater 120. Hence, in various embodiments, the invention avoids duplicity in active circuitry.

Figure 5A:
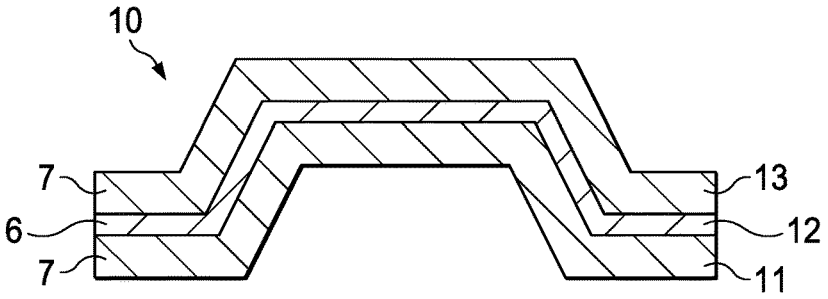
FIGS. 5*a*-5*c*, illustrates a multi-layer film stack used in MEMS devices in accordance with embodiments of the invention.
Figure 5B:
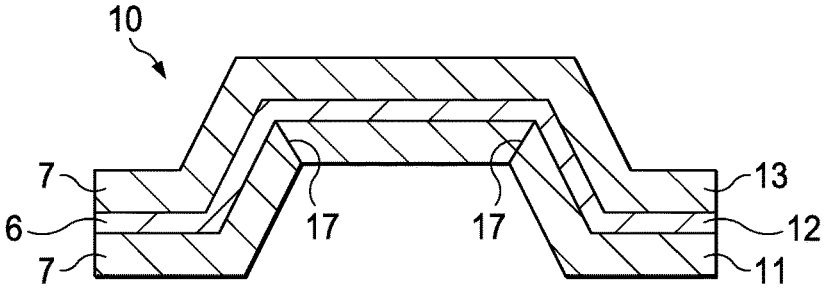
Figure 5C:
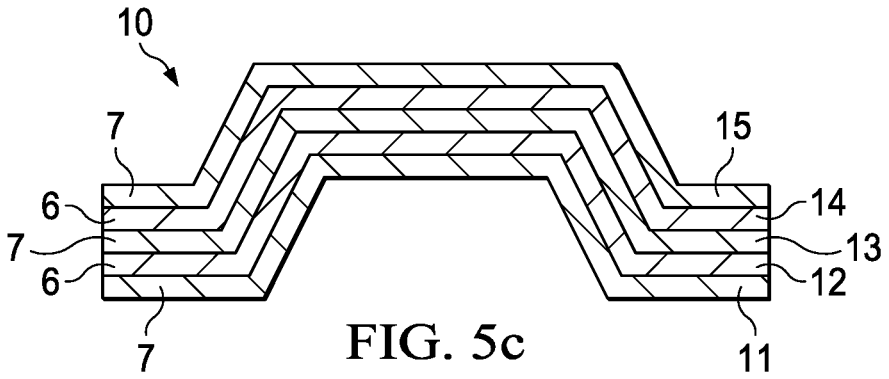

FIG. 5, which includes FIGS. 5*a*-5*c*, illustrates a multi-layer film stack 10 used in MEMS devices in accordance with embodiments of the invention. In various embodiments, the multi-layer film stack 10 may be used as a micro-mirror hinge as described in FIGS. 1 and 2, and/or a heating element for the heater as described in FIGS. 3 and 4.

FIG. 5*a* illustrates a multi-layer film stack 10 comprising three material layers. The multi-layer film stack 10 comprises a first material layer 11, a second material layer 12, and a third material layer 13. In one embodiment, the first material layer 11 and the third material layer 13 comprise a second material 7, and the second material layer 12 comprises a first material 6.

In one embodiment, the first material 6 comprises a material with higher toughness than the second material 7 whereas the second material 7 comprises better resistance to corrosion than the first material 6. The combination of the first material 6 with the second material 7 results in a film with high toughness and high corrosion resistance.

In another embodiment, the second material 7 comprises a material with higher hardness than the first material 6. The first material 6 comprises a material with higher ductility than the second material 7. The combination of the first material 6 with the second material 7 results in a film with high ductility and high impunity to large stresses resulting in a high toughness. In another embodiment, the combination of the first material 6 with the second material 7 improves the creep resistance of the film without significantly degrading the toughness of the film.

In another embodiment, the first material 6 comprises a material with lower resistance and better uniformity in resistivity than the second material 7. Hence, addition of the first material 6 to the second material 7 lowers the resistance and maintains uniformity in resistivity along the film.

In one embodiment, the first material 6 comprises an alloy comprising titanium, and the second material 7 comprises nitrogen, carbon, and/or oxygen in addition to the first material. Ti alloys exhibit good mechanical properties including toughness but poor resistance to corrosion due to the formation of a porous titanium oxide. In contrast, TiAlN or TiCrN films exhibit high resistance to corrosion due to the formation of passive aluminum oxide or chromium oxide. Further, Al and Cr form discontinuities in the columnar grain structure resulting in a decrease in grain boundary diffusivity of corrosive atoms (e.g., oxygen), thus improving resistance to corrosion. However, TiAlN or TiCrN films exhibit poor mechanical properties. Combining the first material 6 with the second material 7 results in films with improved corrosion resistance and toughness.

In various embodiments, the first material 6 comprises TiAl, TiCr, TiCrAl, TiZr, ZrCr, or TaAl and the second material 7 comprises TiAlN, TiCrN, AlCrN, TiAlCrN, TiZrN, ZrCrN, or TaAlN. In one embodiment, the first material 6 comprises about 30% to about 70% Ti and about 30% to about 70% Al, and the second material 7 comprises about 20% to about 50% Ti, about 20% to about 50% Al, and about 20% to about 40% N. In another embodiment, the first material 6 comprises about 30% to about 70% Ti and about 30% to about 70% Cr, and the second material 7 comprises about 20% to about 50% Ti, about 20% to about 50% Cr, and about 20% to about 40% N. In another embodiment, the first material 6 comprises TiAlCr and the second material 7 comprises TiAlCrN. In some embodiments, the first material 6 comprises TiAl and the second material comprises AlCrN. In various embodiments, the first material layer 11 and the third material layer 13 comprise a thickness of about 5% to about 500% of the thickness of the second material layer 12.

In one embodiment, the first material 6 comprises a TiAl alloy comprising about equal amounts of Ti and Al, and the second material 7 comprises TiAlN. In one embodiment, a $Ti_xAl_xN_y$ alloy is used as the second material 7, wherein the amount of nitrogen is greater than 0.2. TiAl alloy exhibits good toughness but poor corrosion resistance. Addition of nitrogen to TiAl improves the corrosion resistance but reduces the toughness of the film. By forming layers of TiAl/TiAlN, films with good corrosion resistance and toughness are fabricated.

As illustrated in FIG. 5*b*, corners in the multi-layer film stack 10 comprise stress concentration regions and may further include cracks 17 due to the columnar grain growth of the first material layer 11. Any such cracks 17 formed during the deposition of the multi-layer film stack 10 is impeded from further growth by the second material layer 12 which comprises a hard material.

Referring to FIG. 5*c*, the multi-layer film stack 10 comprises a first material layer 11, a second material layer 12, a third material layer 13, a fourth material layer 14, and a fifth material layer 15. In one embodiment, the first material layer 11, the third material layer 13, and the fifth material layer 15 comprise a second material 7, and the second material layer 12 and the fourth material layer 14 comprise a first material 6. The first material 6 and the second material 7 are selected as described with respect to FIG. 5*a*.

Figure 6A:
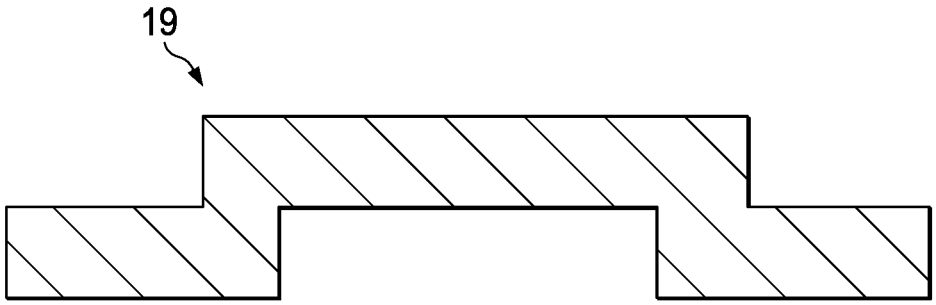
FIGS. 6*a* and 6*b*, illustrates a MEMS feature including a nanostructure comprising at least two material regions, in accordance with embodiments of the invention.
Figure 6B:
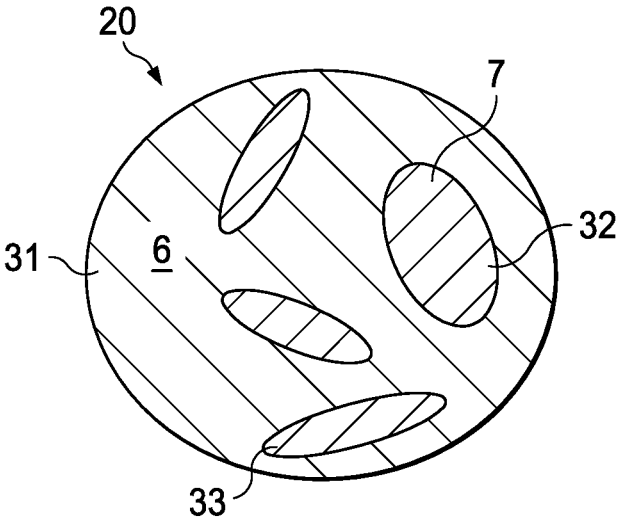

FIG. 6, which includes FIGS. 6*a* and 6*b*, illustrates a MEMS feature 19 comprising a nanostructure 20. FIG. 6*a* illustrates a cross section view of the MEMS feature 19. Unlike the embodiment of FIG. 5, in this embodiment, a first material 6 and a second material 7 form locally within the nanostructure 20. The nanostructure 20 is illustrated in FIG. 6*b* and comprises columnar grains 32 in an amorphous matrix 31. Further, some of the auxiliary grains 33 may comprise a grain-like structure. In various embodiments, the amorphous matrix 31 comprises a first material 6, and the columnar grains 32 comprise a second material 7. In various embodiments, the columnar grains 32 may comprise grains or atomic clusters of a few atomic lengths to several microns in length.

The first material 6 and the second material 7 are selected as described with respect to FIG. 5*a*. In one embodiment, the first material 6 comprises a TiAl alloy comprising about equal amounts of Ti and Al, and the second material 7 comprises TiAlN. The combination of the first material 6 with the second material 7 results in a film with improved mechanical, chemical and electrical properties.

Figure 7:
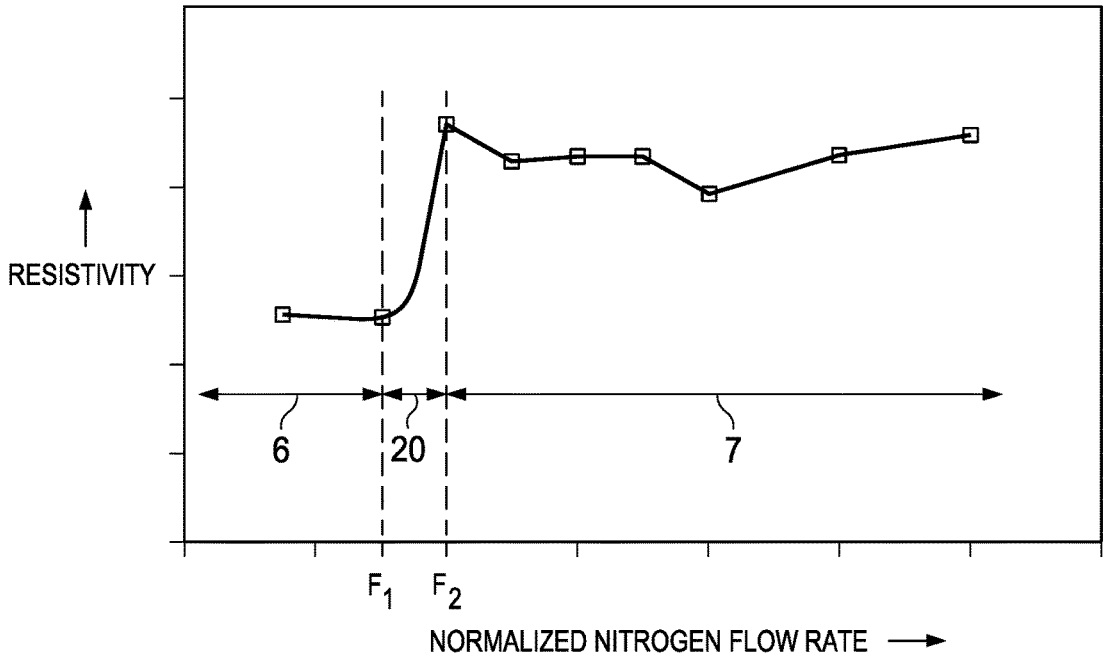
FIG. 7 illustrates deposition of a first material or a second material with nitrogen flow rate during a vapor deposition process, in accordance with embodiments of the invention.

FIG. 7 illustrates deposition of a first material or a second material with nitrogen flow rate during a vapor deposition process, in accordance with embodiments of the invention.

Referring to FIG. 7, the resistivity of a film when deposited as a function of normalized nitrogen flow rate (nitrogen flow rate/total flow rate of all gases) is illustrated. The film is deposited by sputter deposition of TiAl and subject to varying nitrogen flow rates. In various embodiments, other suitable deposition techniques such as chemical vapor deposition may also be used. The nitrogen content of the films deposited is a function of the nitrogen flow rate, and hence, FIG. 7 also schematically illustrates the physical property with nitrogen content in the film.

As illustrated in FIG. 7, at low nitrogen flow rates less than first flow rate $F_1$, a first material 6 is deposited. If the sputter deposition target electrode comprises TiAl, the first material 6 deposited comprises atoms of TiAl. At large nitrogen concentrations (beyond a second flow rate $F_2$), a second material 7 comprising TiAlN is deposited. The first material 6 and the second material 7 comprise different resistivities. In various embodiments, the resistivity of the second material 7 is higher than the resistivity of the first material 6 by at least 50% and about 75% in one embodiment.

As illustrated in FIG. 7, a large process window exists for the deposition of either the first material 6 or the second material 7. In various embodiments, the first and the second flow rates $F_1$ and $F_2$ are less than about 300 sccm, while the total flow rate of gases within the sputtering chamber is less than about 500 sccm, at a sputtering pressure of about 0.5 mTorr to about 30 mTorr. The sputtering power is about 0.1 kW to about 20 kW. The distance between the target electrode and the substrate being sputtered is about 4000 mm to about 6000 mm. The plasma voltage is about 0.1V to about 1000V, and the temperature of the sputtering chamber is about 50° C. to about 400° C. In one embodiment, the first flow rate $F_1$ is about 35 sccm to about 260 sccm. The second flow rate $F_2$ is about 50 sccm to about 300 sccm. The flow rate of other gases within the chamber is about 30 sccm to about 100 sccm at a sputtering pressure of about 0.85 mTorr to about 12 mTorr. In some embodiments, due to the large number of process variables, FIG. 7 is generated every time the tool is brought online, for example, after servicing operations, and the first and the second flow rates $F_1$ and $F_2$ are determined empirically. In various embodiments, the first material 6 comprises up to about 20% nitrogen, whereas the second material 7 comprises about 30% to about 50% nitrogen.

If the nitrogen flow rate is between the first and the second flow rates $F_1$ and $F_2$, a nanostructure 20 comprising the first and the second material 6 and 7 is deposited. The nanostructure 20, as also described with respect to FIG. 6, comprises a combination of a columnar and grainy structure.

Alternatively, in various embodiments, first and second partial ratios are used instead of the first and the second flow rates. The first partial ratio is a ratio of the first flow rate $F_1$ of nitrogen to a total flow rate of all gases into the sputter deposition chamber, and the second partial ratio is a ratio of the second flow rate $F_2$ of nitrogen to a total flow rate of all gases into the sputter deposition chamber. In various embodiments, the first partial ratio varies from about 0.01 to about 0.8, and the second partial ratio varies from about 0.05 to about 1.

Figure 8A:
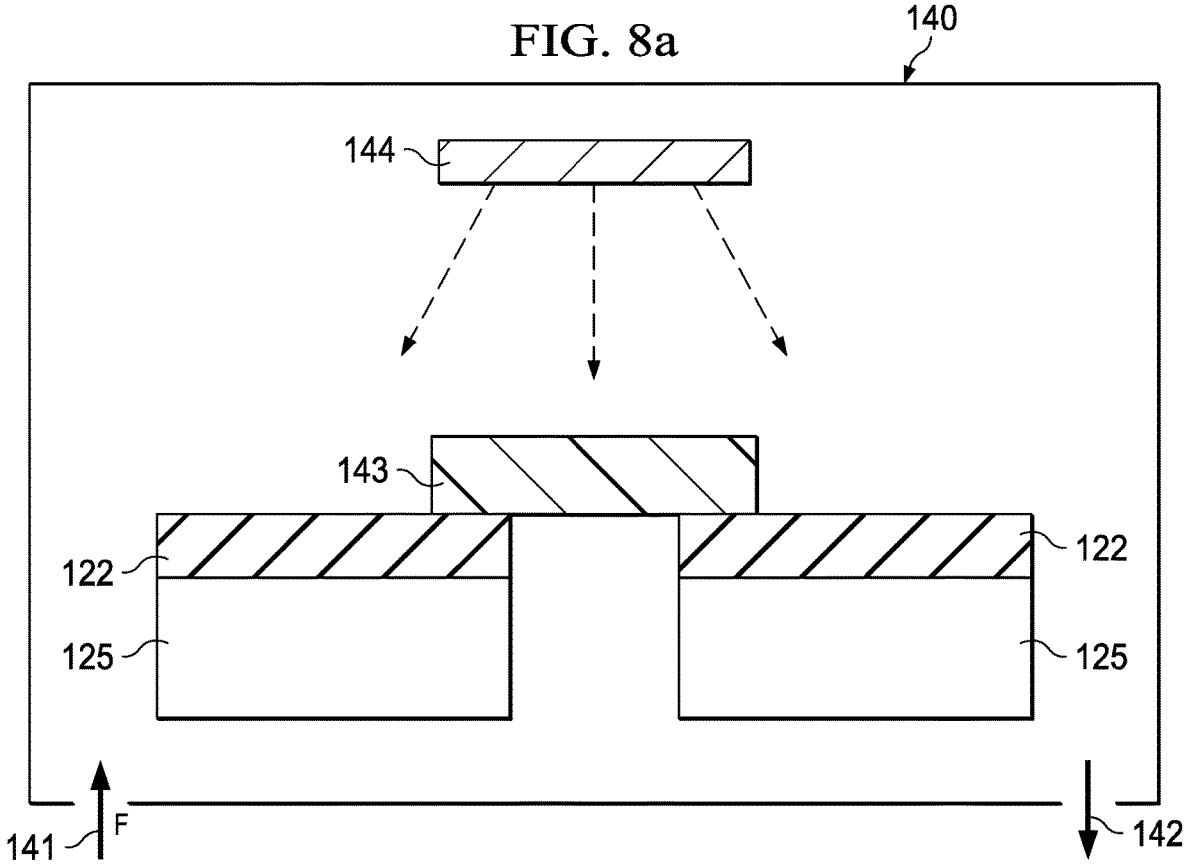
FIGS. 8*a*-8*c*, illustrates a MEMS device in various stages of fabrication using a deposition process, in accordance with an embodiment of the invention.
Figure 8B:
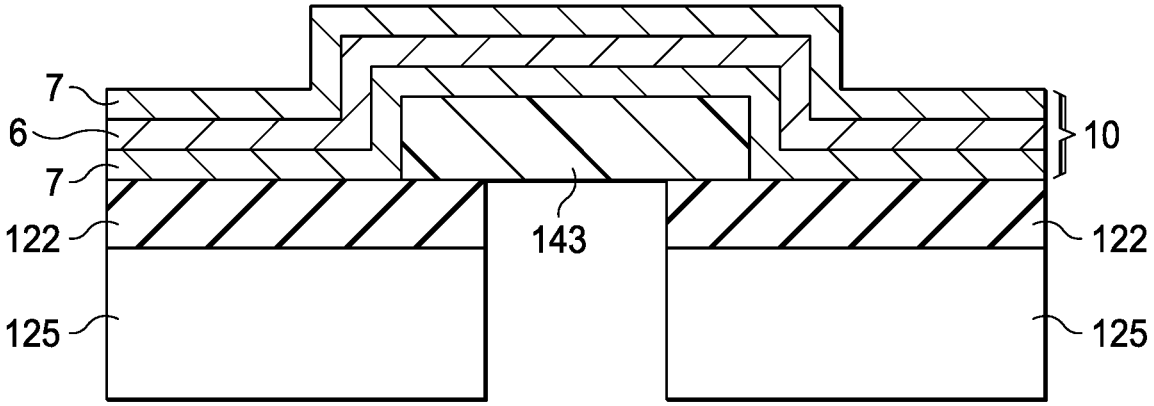
Figure 8C:
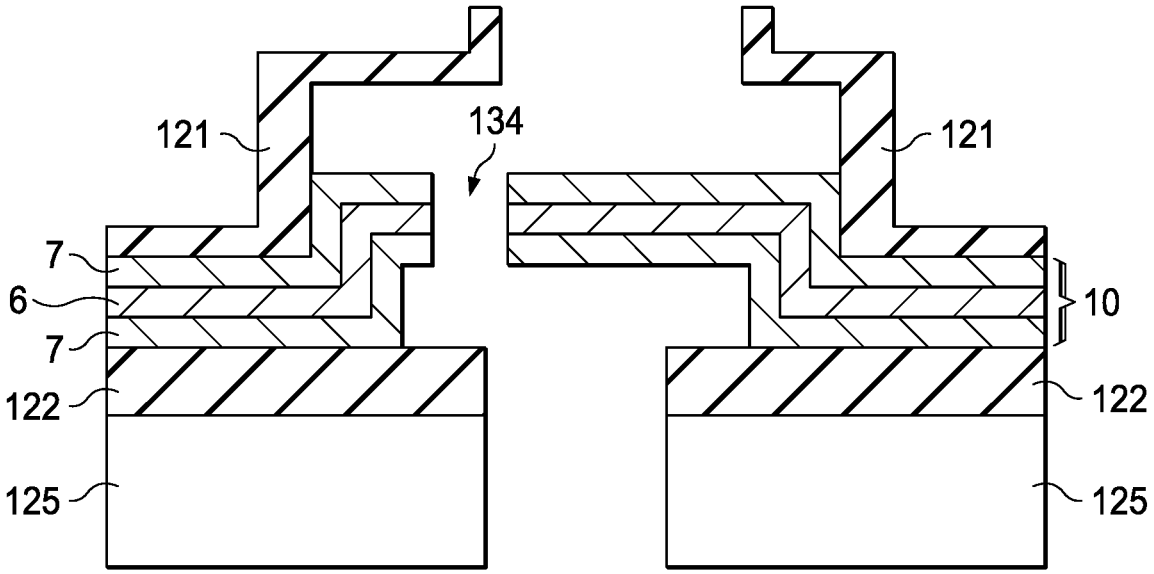

FIG. 8, which includes FIGS. 8*a*-8*c*, illustrates a MEMS device in various stages of fabrication, in accordance with an embodiment of the invention. In the embodiment, the nitrogen flow rate is controlled to form separate material layers of either a first material 6 or a second material 7 as described in FIG. 7.

A workpiece 125 comprising a semiconductor substrate, for example, a wafer is first fabricated using conventional techniques. The workpiece 125 comprises integrated circuitry and circuitry to drive the print head 100 (being formed). Active devices as well as metallization layers are fabricated. A passivation layer 122 is deposited over the workpiece 125 and coupled to a cathode potential node. A sacrificial material 143 is deposited over the passivation layer 122 and patterned.

Referring to FIG. 8*a*, the deposition chamber 140 comprises inlets 141 and outlets 142 for the flow of required gases. The gas chemistry comprises nitrogen at a flow rate F into the deposition chamber 140. The gas chemistry may additionally comprise inert gases such as argon. A target 144 comprising the material to be deposited is placed inside the deposition chamber 140. In various embodiments, the target 144 comprises TiAl, TiAlCr, TiCr, TiZr, ZrCr, and/or TaAl.

The workpiece 125 is transferred into a deposition chamber 140 and placed upon an anode potential node. In one embodiment, the deposition chamber 140 comprises a chamber used for processes such as a reactive sputter deposition and/or magnetron sputter deposition. A plasma is generated within the deposition chamber 140 that furnishes energy to the nitrogen gas and dissociates it into atomic nitrogen.

The target 144 is sputtered by the ionized argon plasma and deposits atoms of the target 144 over the workpiece 125 (FIG. 8*b*). The atomic nitrogen is incorporated into the deposited multi-layer film stack 10 depending on the available nitrogen. In various embodiments, the nitrogen flow rate is either less than the first flow rate $F_1$ or greater than the second flow rate $F_2$ forming a multi-layer film stack 10 comprising a first material 6 and a second material 7. As the second flow rate $F_2$ is larger than the first flow rate $F_1$, the second material 7 has a higher concentration of nitrogen.

The multi-layer film stack 10 is patterned to an appropriate shape. For example, heater opening 134 (FIG. 8*c*) is formed by etching out a portion of the multi-layer film stack 10 after a masking step. The sacrificial layer 143 is etched and removed, and subsequent processing forms a nozzle 121.

Figure 9A:
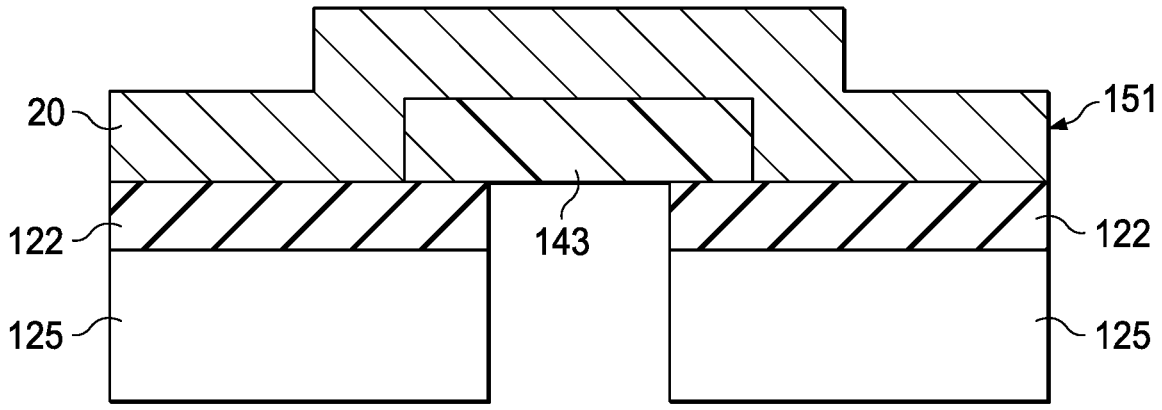
FIGS. 9*a* and 9*b*, illustrates a MEMS device in various stages of fabrication using an alternative deposition process, in accordance with an embodiment of the invention.
Figure 9B:
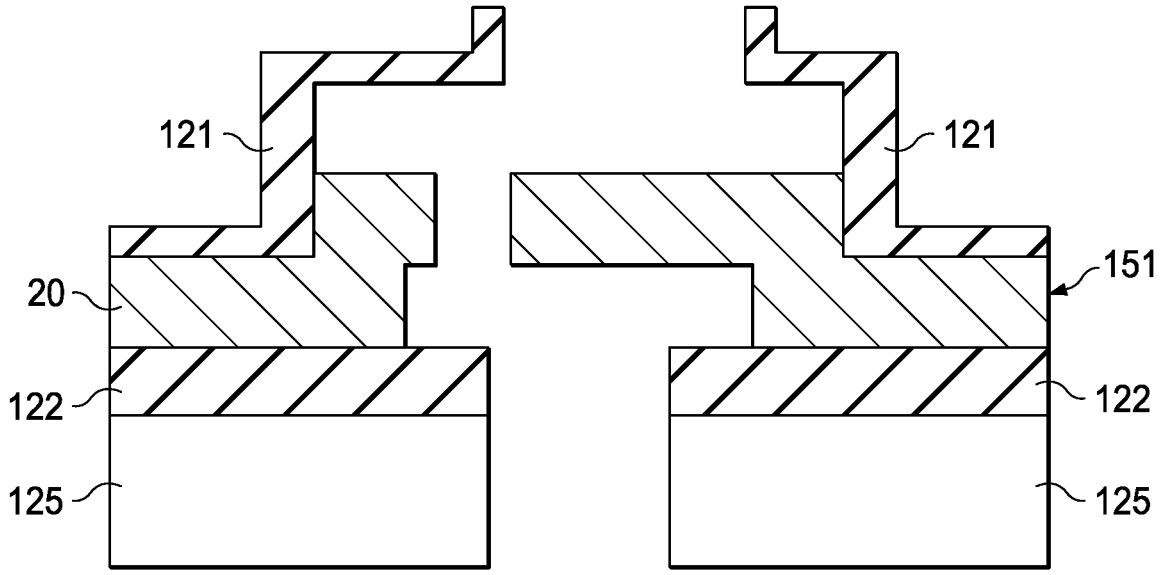

FIG. 9, which includes FIGS. 9*a* and 9*b*, illustrates a MEMS device in various stages of fabrication, in accordance with an embodiment of the invention. FIG. 9*a* illustrates a stage of the MEMS device comprising the nanostructure 20, the single layer 151, the sacrificial material 143, the passivation layer 122, and the workpiece 125. FIG. 9*b* illustrates a stage of the MEMS device comprising the nozzle 121, the nanostructure 20, the single layer 151, the passivation layer 122, and the workpiece 125. In this embodiment, the nitrogen flow rate F is controlled to form single material layer comprising local regions of a first material 6 or a second material 7.

The method follows a process similar to the embodiment of FIG. 8 in forming a workpiece 125, a passivation layer 122, and a sacrificial layer 143. However, the sputter deposition process is different.

The flow rate F of nitrogen is controlled to be within the first and the second flow rates $F_1$ and $F_2$ as described with respect to FIG. 7. Hence, a single layer 151 comprising the nanostructure 20 is deposited over a sacrificial layer 143. The nanostructure 20 comprises amorphous regions comprising a first material 6 and columnar grains comprising a second material 7 (for example, see FIG. 6*b*). The columnar grains are nitrogen rich while the amorphous regions have low levels of nitrogen. The total fraction of nitrogen in the nanostructure is about 0.2 to about 0.4. The single layer 151 is patterned and a nozzle 121 is formed subsequently.

Figure 10A:
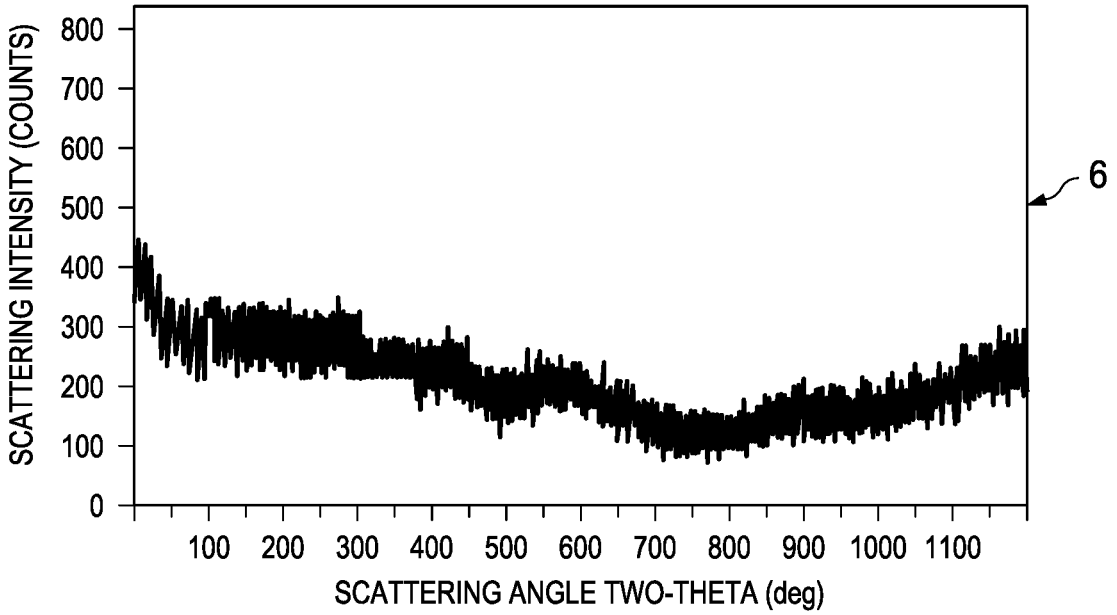
Figure 10B:
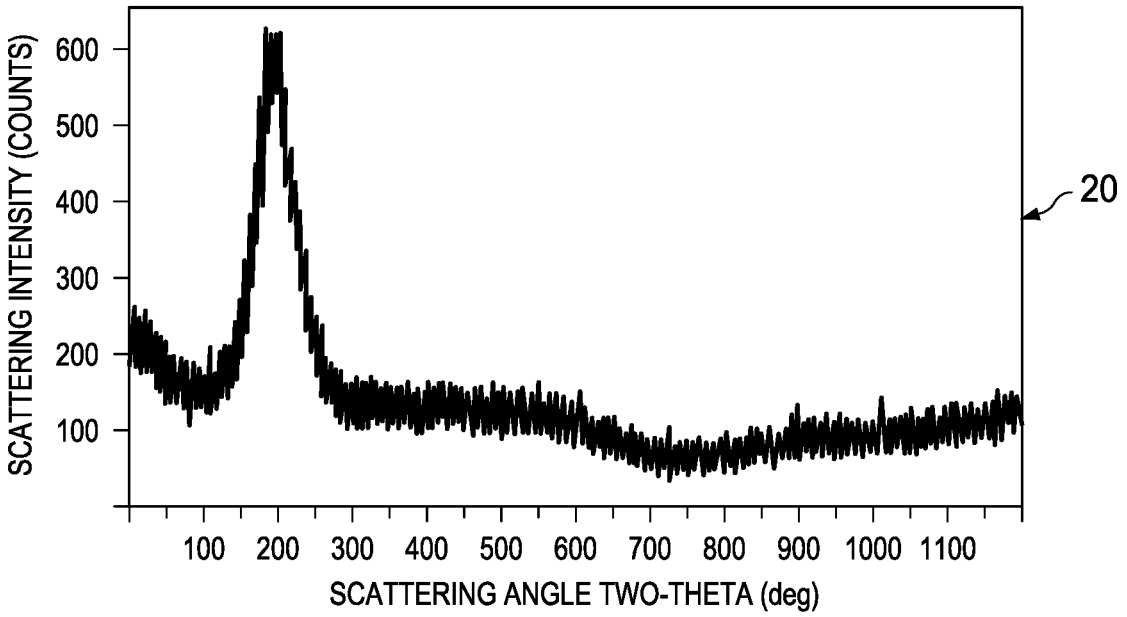
Figure 10C:
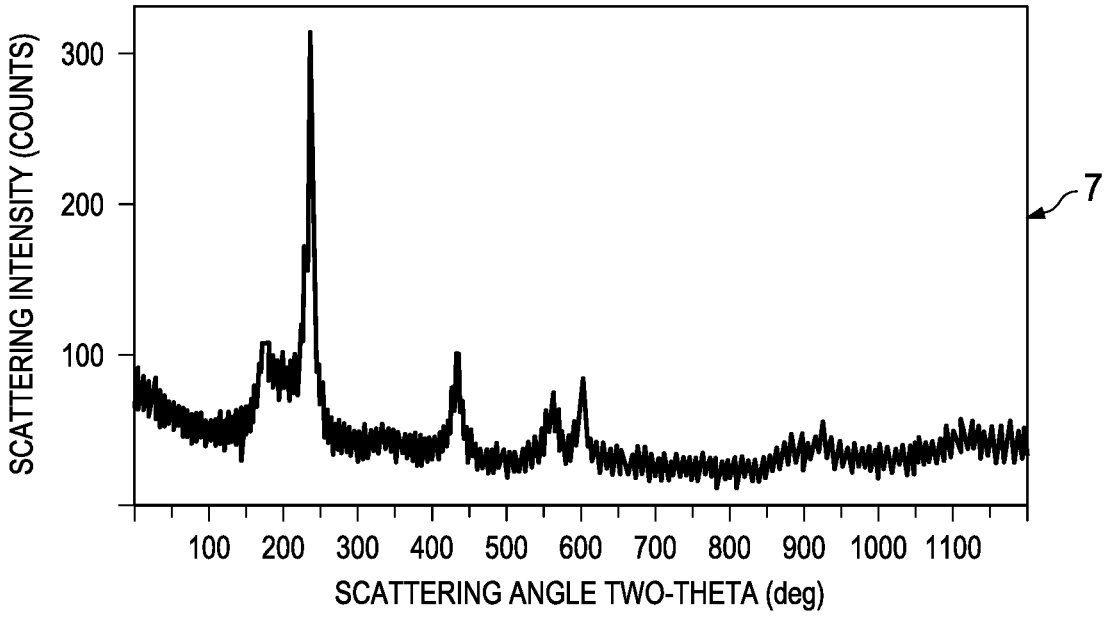

FIG. 10, which includes FIGS. 10*a*-10*c*, illustrates x-ray diffraction peaks of material layers fabricated using embodiments of the invention, wherein FIG. 10*a* illustrates the first material comprising an alloy, FIG. 10*b* illustrates the nanostructure, and FIG. 10*c* illustrates the second material.

Strong peaks in x-ray diffraction patterns indicate the existence of a crystalline material, whereas a diffuse x-ray diffraction pattern suggests a lack of crystallinity or the presence of amorphous regions. Referring to FIG. 10*a*, x-ray diffraction patterns from the first material 6 (e.g., in FIG. 7) lack a significant peak indicating an amorphous material. In contrast, as illustrated in FIG. 10*c*, the x-ray diffraction patterns from the second material 7 (e.g., in FIG. 7) show a crystalline material. The x-ray diffraction patterns from the nanostructure 20 (of FIG. 7) show a partially amorphous region or partially crystalline region. Hence, this structure has some regions that are crystalline while some regions are still amorphous (similar to the nanostructure 20 illustrated in FIG. 6*b*).

In various embodiments, a method of forming a micro electro mechanical system (MEMS) device comprises placing a workpiece to be coated within a sputter deposition chamber, and flowing nitrogen into the sputter deposition chamber at a first partial ratio. The method further comprises forming a first material layer by sputtering a target alloy comprising at least two metals, the first material layer comprising atoms of the target alloy, and changing a partial ratio of nitrogen flowing into the sputter deposition chamber to a second partial ratio, the second partial ratio being higher than the first partial ratio, wherein the partial ratio of nitrogen is a ratio of a flow rate of nitrogen to a total flow rate of all gases. A second material layer is formed on the first material layer, the second material layer comprising target alloy atoms and atomic nitrogen, the first material layer and the second material layer comprising different resistivity materials. In an embodiment, the first partial ratio is a ratio of a first flow rate of nitrogen to a total flow rate of all gases into the sputter deposition chamber, wherein the first flow rate is about 20 sccm to about 300 sccm, and the second flow rate is about 50 sccm to about 350 sccm. In a further embodiment, the second partial ratio is a ratio of a second flow rate of nitrogen to a total flow rate of all gases into the sputter deposition chamber. In various embodiments, the total flow rate of all gases through the chamber is about 80 sccm to about 450 sccm, and a sputtering pressure within the chamber is about 0.5 mTorr to about 15 mTorr. In an embodiment, a resistivity of the second material layer is at least 50% higher than a resistivity of the first material layer. In another embodiment, the target alloy is selected from the group consisting of TiAl, TiCr, TiAlCr, TiZr, ZrCr, and TaAl, and wherein the first material layer comprises less than 10% nitrogen, and wherein the second material layer comprises at least 20% nitrogen. In various embodiments, the method further comprises changing the partial ratio of nitrogen flowing into the sputter deposition chamber to a third partial ratio, the third partial ratio being lower than the second partial ratio, and forming a third material layer on the second material layer, the third material layer comprising the target alloy, the first material layer and the third material layer comprising a same resistivity material. In an embodiment, the first, the second, and the third material layers form a hinge, the hinge supporting a moving element disposed on the first material layer, the moving element comprising a micro mirror. In an embodiment, the first, the second, and the third material layers form a heater suspended in an ink chamber of a print head, the heater configured to heat an ink disposed within the ink chamber. In an embodiment, the method further comprises changing the partial ratio of nitrogen flowing into the sputter deposition chamber to the second partial ratio, and forming a fourth material layer on the third material layer, the fourth material layer comprising the target alloy and nitrogen, the second material layer and the fourth material layer comprising a same resistivity material. The method further comprises changing the partial ratio of nitrogen flowing into the sputter deposition chamber to the first partial ratio, and forming a fifth material layer on the fourth material layer, the fifth material layer comprising the target alloy, the first, the third, and the fifth material layers comprise a same resistivity material.

In an alternative embodiment, a method of forming a micro electro mechanical system (MEMS) device comprises identifying a first partial ratio of nitrogen through a deposition chamber for depositing a first film of a first resistivity, and identifying a second partial ratio of nitrogen through the deposition chamber for depositing a second film of a second resistivity, the second resistivity being higher than the first resistivity. The method further comprises placing a workpiece to be coated within the deposition chamber, and flowing nitrogen into the deposition chamber at a third partial ratio between the first partial ratio and the second partial ratio and forming atomic nitrogen within the deposition chamber. A partial ratio of nitrogen is a ratio of a flow rate of nitrogen to a total flow rate of all gases into the deposition chamber. The method further comprises forming a material layer by sputter deposition of a target alloy comprising at least two metals and the atomic nitrogen. In an embodiment, the material layer comprises a nanostructure, the nanostructure comprising an amorphous region comprising atoms of the target alloy and at least one region comprising columnar grains and comprising atoms of the target alloy and atomic nitrogen. In an embodiment, the material layer comprises more than about 20% nitrogen and less than about 40% nitrogen. In an embodiment, the second resistivity is at least 50% higher than the first resistivity, and wherein the deposition comprises using a reactive sputter deposition process. In an embodiment, the target alloy is selected from the group consisting of TiAl, TiCr, TiAlCr, TiZr, ZrCr, and TaAl. In an embodiment, the material layer forms a hinge, the hinge supporting a micro mirror disposed on the material layer. In an embodiment, the material layer forms a heater suspended in an ink chamber of a print head, the heater configured to heat an ink disposed within the ink chamber.

In one aspect, embodiments disclosed herein provide for a micro electro mechanical system (MEMS) device comprising an ink chamber disposed over a substrate, and a heating element suspended in the ink chamber. The heating element is configured to heat an ink disposed within the ink chamber. The heating element comprises a first region comprising an alloy and a second region comprising the alloy and nitrogen and the alloy comprises at least two metals.

In another aspect, embodiments disclosed herein provide for a micro electro mechanical system (MEMS) device comprising a workpiece, a passivation layer on the workpiece, and a chamber above the workpiece. The device also includes a heater element extending from a sidewall of the chamber into the chamber. The heater element has a first region comprising a two metal alloy and a second region comprising a nitride of the two metal alloy.

In yet another aspect, embodiments disclosed herein provide for a micro electro mechanical system (MEMS) device comprising a bottom layer disposed over a substrate, an inner material layer disposed on the bottom layer, a top layer disposed on the inner material layer. The device also includes a moving element disposed on the top layer, wherein the inner material layer comprises an alloy of at least two metals, and wherein the top and bottom layers comprise the alloy and nitrogen, and wherein the top layer, the inner material layer, and the bottom layer form a hinge supporting the moving element.

Although the present invention and its advantages have been described in detail, it should be understood that various changes, substitutions and alterations can be made herein without departing from the spirit and scope of the invention as defined by the appended claims. For example, it will be readily understood by those skilled in the art that many of the features, functions, processes, and materials described herein may be varied while remaining within the scope of the present invention.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A micro electro mechanical system (MEMS) device comprising:

a hinge disposed over a substrate, the hinge comprising a nanostructure, wherein the nanostructure comprises:

amorphous regions of a first material; and columnar grains of a second material different from the first material, wherein the columnar grains are enclosed within the amorphous regions; and a movable element disposed on the hinge and supported by the hinge.

2. The MEMS device of claim 1, wherein the amorphous regions form an amorphous matrix, and the columnar grains are within the amorphous matrix.

3. The MEMS device of claim 1, wherein a surface area of the movable element is larger than a surface area of the hinge.

4. The MEMS device of claim 1, wherein the first material comprises an alloy of at least two metals, and the second material comprises the alloy and nitrogen.

5. The MEMS device of claim 4, wherein the alloy is selected from the group consisting of TiAl, TiCr, TiAlCr, TiZr, ZrCr, and TaAl.

6. The MEMS device of claim 4, wherein the alloy comprises equal amounts of the at least two metals.

7. The MEMS device of claim 1, wherein the first material has higher toughness than the second material, and the second material has higher corrosion resistance than the first material.

8. A micro electro mechanical system (MEMS) device comprising:

a micro mirror; and a MEMS feature, the MEMS feature comprising a nanostructure, and the nanostructure comprising:

amorphous regions of a first material comprising an alloy of at least two metals, wherein the amorphous regions form an amorphous matrix contacting the micro mirror; and columnar grains of a second material comprising the alloy and nitrogen.

9. The MEMS device of claim 8, wherein the MEMS feature comprises a first portion, a second portion, and a third portion, wherein a top surface of the first portion, a bottom surface of the second portion, and a top surface of the third portion are horizontally aligned with one another.

10. The MEMS device of claim 8, further comprising:

a substrate, wherein the MEMS feature is disposed over the substrate, and the MEMS feature supports the micro mirror.

11. The MEMS device of claim 8, wherein a surface area of the micro mirror is larger than a surface area of the MEMS feature.

12. The MEMS device of claim 8, wherein the columnar grains are within the amorphous matrix.

13. The MEMS device of claim 8, wherein the alloy is selected from the group consisting of TiAl, TiCr, TiAlCr, TiZr, ZrCr, and TaAl.

14. The MEMS device of claim 8, wherein the alloy comprises equal amounts of the at least two metals.

15. The MEMS device of claim 8, wherein the first material has higher toughness than the second material, and the second material has higher corrosion resistance than the first material.

16. A micro electro mechanical system (MEMS) device comprising:

an ink chamber disposed over a substrate; and a heating element suspended in the ink chamber, the heating element configured to heat an ink disposed within the ink chamber, the heating element comprising a nanostructure, wherein the nanostructure comprises:

amorphous regions of a first material having a first resistivity; and columnar grains of a second material different from the first material, the second material having a second resistivity higher than the first resistivity.

17. The MEMS device of claim 16, wherein the first material comprises an alloy of at least two metals, and the second material comprises the alloy and nitrogen.

18. The MEMS device of claim 17, wherein the alloy is selected from the group consisting of TiAl, TiCr, TiAlCr, TiZr, ZrCr, and TaAl.

19. The MEMS device of claim 16, wherein the first material has higher toughness than the second material, and the second material has higher corrosion resistance than the first material.

20. The MEMS device of claim 16, wherein the amorphous regions form an amorphous matrix, and the columnar grains are within the amorphous matrix.

* * * * *